US008090075B2

(12) United States Patent
Holm et al.

(10) Patent No.: US 8,090,075 B2
(45) Date of Patent: Jan. 3, 2012

(54) X-RAY TUBE WITH AN ANODE INSULATION ELEMENT FOR LIQUID COOLING AND A RECEPTACLE FOR A HIGH-VOLTAGE PLUG

(75) Inventors: Kurt Holm, Baden (CH); Adrian Riedo, Düdingen (CH); Hans Reusser, Helgisried (CH)

(73) Assignee: Comet Holding AG, Flamatt (CH)

( * ) Notice: Subject to any disclaimer, the term of this patent is extended or adjusted under 35 U.S.C. 154(b) by 137 days.

(21) Appl. No.: 12/595,697

(22) PCT Filed: Jun. 6, 2007

(86) PCT No.: PCT/EP2007/055605

§ 371 (c)(1), (2), (4) Date: Oct. 13, 2009

(87) PCT Pub. No.: WO2008/148426

PCT Pub. Date: Dec. 11, 2008

(65) Prior Publication Data

US 2010/0111265 A1 May 6, 2010

(51) Int. Cl.
*H01J 35/12* (2006.01)

(52) U.S. Cl. ..... 378/141

(58) Field of Classification Search ..... 378/119, 378/121, 130, 141

See application file for complete search history.

(56) References Cited

U.S. PATENT DOCUMENTS 2,067,139 A 1/1937 Ehrke

FOREIGN PATENT DOCUMENTS

| | | | |
|---|---|---|---|
| DE | 615691 C | | 7/1935 |
| DE | 674415 C | | 4/1939 |
| GB | 1272496 | * | 4/1972 |
| GB | 1272498 A | | 4/1972 |

OTHER PUBLICATIONS

International Search Report for corresponding International Application PCT/EP2007/055605.

* cited by examiner

*Primary Examiner* — Courtney Thomas
(74) *Attorney, Agent, or Firm* — WRB-IP LLP

(57) ABSTRACT

In a high-voltage X-ray tube, which a cathode, which is held at negative high voltage during operating conditions, and an anode, which is held at positive high voltage during operating conditions, are disposed opposite each other in a vacuumized inner space, the anode being attached to an anode insulation element in such a way that the anode insulation element has a cylindrical shape or a shape tapering toward the anode and includes an opening to receive a high-voltage plug, and a pipe structure is provided by means of which a coolant is able to be supplied to the anode. This coolant can be in particular insulating oil or another electrically non-conducting liquid. The pipe structure can, for example, be integrated completely into the interior of the anode insulation element, but can also be integrated into the surface of the high-voltage plug. A solution is also possible in which the pipe structure is integrated into an intermediate element, which is situated between the anode insulation element and the high-voltage plug.

8 Claims, 8 Drawing Sheets

State of Art

State of Art

X-RAY TUBE WITH AN ANODE INSULATION ELEMENT FOR LIQUID COOLING AND A RECEPTACLE FOR A HIGH-VOLTAGE PLUG

BACKGROUND AND SUMMARY

The invention relates to a high-voltage X-ray tube, in which a cathode, held at negative high voltage during operating conditions, and an anode, held at positive high voltage during operating conditions, are disposed opposite each other in a vacuumized interior space. The invention relates in particular to such a high-voltage X-ray tube in which the anode is attached to an anode insulation element.

X-ray tubes in metal are preferably produced nowadays in coaxial design, the outer jacket of the tube being held at ground and the cathode or respectively the anode being fixed in the interior by a ceramic insulator. These specially shaped ceramic insulators are primarily made of Al2O3 ceramic. In addition, with these so-called metal-ceramic X-ray tubes, a distinction is made between two designs, depending upon the structure of the ceramic insulator, namely between the use of disc-shaped ceramic on the one hand, and the use of cylindrical or conical ceramic on the other hand.

In the case of the ceramic disc X-ray tube, the insulation path lies transversely to the tube axis. So that sufficient voltage sustaining capability can be ensured, the disc must therefore have an adequate diameter. A recommended value of 1 cm pro 50 kV thereby applies. The use of disc-shaped insulators thus leads to tubes with large diameter but short overall length. With such X-ray tubes, the high voltage is supplied by way of a special insulating adapter, which receives the cable with the high-voltage plug and connects it in a suitable way to the tube anode, or respectively tube cathode, via the ceramic disc element. The drawbacks of this solution consist in that the tube is given a large diameter and—owing to the lead covering necessary for reasons of radiation protection—a large amount of weight. Furthermore, for reasons relating to high voltage technology, the ceramic disc element is not ideal since the direction of field strength runs parallel to the ceramic surface, and thus there exists the risk of instability through flashover. Through the installation of a special adapter moreover two separate insulation bounding surfaces occur, which represent additional risks of high voltage flashover.

To avoid this and further drawbacks of the ceramic disc element, cylindrical or respectively conical insulations are also used. These have the electrical advantage that the field strength runs to a large extent perpendicular to the surface, and such a tube is therefore not as susceptible to electrical flashover. In addition, they make possible a narrow structural shape for the tube since the ceramic-insulation path runs parallel to the tube axis, and the dielectric strength is considerably greater through the vacuum than parallel to the ceramic surface. Since the commercially available high-voltage plugs can be directly connected to the ceramic element, a special adapter is not necessary, and the overall length can be kept short.

Since the anode in an X-ray tube is heated up by the electron beam during operation, a special anode cooling is required. This can take place in a simple way by air or water, but only in those situations in which the anode is held at ground potential, however. The X-ray tubes in which the one electrode, preferably the anode, is held at ground potential, and the second electrode, preferably the cathode, is held at high voltage are referred to as so-called unipolar X-ray tubes. Conversely, in so-called bipolar X-ray tubes, both electrodes are held at a high voltage.

As already mentioned a little further above, the conical ceramic as insulator in X-ray tubes has been especially successful. It permits, on the one hand, a high degree of voltage sustaining capability, and, on the other hand, it also ensures a compact design. In unipolar tubes, such a ceramic is preferably employed on the cathode side. The anode is then grounded, and can be cooled with water (or, if need be, with air).

A problem arises with bipolar tubes, however. Since the anode in these bipolar X-ray tubes is also held at high voltage, like the cathode, the anode cooling must be carried out in an insulated way since a high potential difference exists between the anode and the cooling unit. Insulating oil is preferably used in this case for cooling the anode. In this design, the integration of the anode cooling system in the conical ceramic part represents a problem, however. According to the conventional solutions, a special adapter must again be used for this, which contains the insulated cooling lines and the high voltage connection. This solution is complex and costly in manufacture; it also creates additional bounding surfaces at risk from high voltage, and leads moreover to an enlargement of the diameter of the tube. Thus the aims of simplicity in design, reliability and compactness of the X-ray tube cannot be achieved at all or only in insufficient measure.

It is desirable to propose a new high-voltage X-ray tube which does not have the drawbacks of the state of the art. It is desirable to provide such a bipolar high-voltage X-ray tube, which, on the one hand, has an especially compact design, and which at the same time also ensures the cooling of the anode, held at high voltage, such that reliability in operation is guaranteed at all times (in particular no oil leak possible, stable at high voltage), and that the tube is robust and is not damaged, even with transport and continuous operation.

According to an aspect of the invention a high-voltage X-ray tube is provided in which a cathode, which is held at negative high voltage during operating conditions, and an anode, which is held at positive high voltage during operating conditions, are disposed opposite each other in a vacuumized inner space, the anode being attached to an anode insulation element, the anode insulation element has a cylindrical shape or a shape tapering toward the anode, and includes an opening to receive a high-voltage plug, and a pipe structure is provided by means of which a coolant is able to be supplied to the anode. The advantage of this invention lies in particular in that the X-ray tube according to the invention is able to combine a compact design with a simple and reliable anode cooling. By means of the shape tapering toward the anode, all advantages of X-ray tubes can be kept which are based on the principle of the conical or cylindrical ceramic element. Moreover a significant reduction in size can be achieved, compared with conventional tubes, since the cooling of the anode can be achieved without additional adapter or other similar intermediate elements, thanks to the provided pipe structure.

In an embodiment variant, the coolant is insulating oil or another electrically non-conducting liquid or fluid. This embodiment variant has above all the advantage that already tried and proven means of cooling and approaches to cooling can be used. Furthermore, through the use of an electrically non-conducting liquid or fluid, the problem of unwanted electrical flashover is solved, so that the X-ray tube can be operated at all times with a high degree of safety and reliability.

In still another embodiment variant, the pipe structure comprises at least one inflow channel and at least one outflow channel. The advantage of this embodiment variant lies above all in that a closed circuit is formed, through which the coolant may circulate unhampered. By means of a channel structure in which the coolant flows in each case in one direction only, oil bottlenecks or other problems of this kind in the cooling system can moreover be completely eliminated. Finally, also a greater flow rate and thus also a faster cooling of the anode can thereby be ensured.

In a further embodiment variant, the pipe structure is integrated completely into the interior of the anode insulation element. The advantage of this embodiment variant lies in particular in that absolutely no additional elements are needed for anode cooling. The pipe structure is located completely inside the anode insulation element, so that in particular no changes in the high-voltage plug are necessary. In this embodiment variant, therefore, the standard high voltage plugs can continue to be used. Furthermore no special maintenance or special handling during operation is necessary since the pipe structure is well protected from external influences by the wall of the insulation layer.

In another embodiment variant, the pipe structure is integrated into the surface of the anode insulation element turned toward the high-voltage plug, the pipe structure being at least partially open toward the outside. This embodiment variant has in particular the advantage of very easy access to the pipe structure. In particular, this makes possible very simple control or respectively very simple upkeep of the pipe structure. Last but not least, the manufacture of such an anode insulation element is also considerably simplified. In addition, the maintenance is also further simplified since the grease otherwise used between the anode insulation element and the high-voltage plug resinifies, as a rule, over time and has to be renewed.

In still another embodiment variant, the pipe structure is able to be sealed off by the surface of the high-voltage plug. The advantage of this embodiment variant lies in particular in that the surface of the high-voltage plug can be used automatically for sealing off of the pipe structure. Thus also no additional elements or seals are needed. The coolant can then circulate freely in the respective channels, without oil leaks occurring.

In a further embodiment variant, provided on the high-voltage plug are sealing means, by means of which the pipe structure is able to be sealed off. This embodiment variant has above all the advantage that the sealing can be improved and optimized through use of special sealing means. Thus it can be ensured at all times that the pipe structure is closed off optimally, and that the coolant does not come into contact with the outer air. Moreover the high-voltage plug can also be pulled out even when the coolant is still in the pipe structure, for example, without this coolant escaping. The safety in use and the simplicity of handling of a high-voltage X-ray tube according to this embodiment variant are thereby brought to an especially high level. Likewise, in the case of damage to the sealing means, only this element has to be replaced, while the same high-voltage plug can continue to be used.

In still another embodiment variant, the pipe structure is integrated into the surface of the high-voltage plug. The most important advantage of this embodiment variant lies above all in the very easy access to the pipe structure, akin to the embodiment variant with the pipe structure in the surface of the anode insulation element. That makes possible above all very easy control or respectively very easy upkeep of the pipe structure, whereby the maintenance is also considerably simplified. However, made possible by means of this embodiment variant is the use of standardized anode insulation elements (i.e. such as are also usable with unipolar X-ray tubes, for example), while the pipe structure comes to lie exclusively within the high-voltage plug.

In another embodiment variant, the pipe structure is integrated into an intermediate element, the intermediate element being disposed between the anode insulation element and the high-voltage plug. The advantage of this embodiment variant lies in particular in that both standardized high-voltage plugs and standardized anode insulation elements are usable. Thus the pipe structure for guiding of the coolant is integrated into a completely new element, which can be manufactured and also installed separately. Also the maintenance of such a pipe structure is thereby especially simplified. In the case of failure or massive damage to the pipe structure, the intermediate element can also be very easily replaced, without the entire anode insulation element and/or the high-voltage plug being used also being affected.

In still another embodiment variant, the at least one inflow channel and/or the at least one outflow channel are of helical design. This embodiment variant has in particular the advantage that by means of the helical shape, a much greater length is achievable for the conducting channels. The insulation path in the coolant can thereby be increased, and the voltage sustaining capability and reliability of the tubes improved.

In a further embodiment variant, the at least one inflow channel and/or the at least one outflow channel are of rectilinear design. The advantage of this embodiment variant is in particular that a pipe structure with straight channels is produced considerably more easily and can essentially be maintained considerably more easily. In addition, the possibility of bottlenecks of liquid in the pipe structure is clearly smaller with straight channels. The coolant can also be conducted very quickly to the anode, which can be an advantage at very high temperatures.

In another embodiment variant, the pipe structure is producible by boring and/or casting. The advantage of this embodiment variant lies above all in that standardized manufacturing methods can be applied to produce the pipe structure for the coolant (e.g. the cooling liquid). A smooth surface of the channels in the pipe structure can also be obtained by boring or by casting, which is decisive for a friction-free flow of the cooling liquid.

In still another embodiment variant, the at least one inflow channel and/or the at least one outflow channel have a round or oval cross section. This embodiment variant has above all the advantage that an optimal channel shape is used for the circulation of the coolant in the pipe structure. Thus the possibility of a bottleneck or another difficulty is greatly reduced.

It should be mentioned here that in addition to the high-voltage X-ray tube according to the invention, this invention also relates to a corresponding method for producing the high-voltage X-ray tube according to the invention.

BRIEF DESCRIPTION OF DRAWINGS

The embodiment variants of the present invention will be described in the following with reference to examples. The examples of the embodiments are illustrated by the following attached figures.

DETAILED DESCRIPTION

Figure 1A:
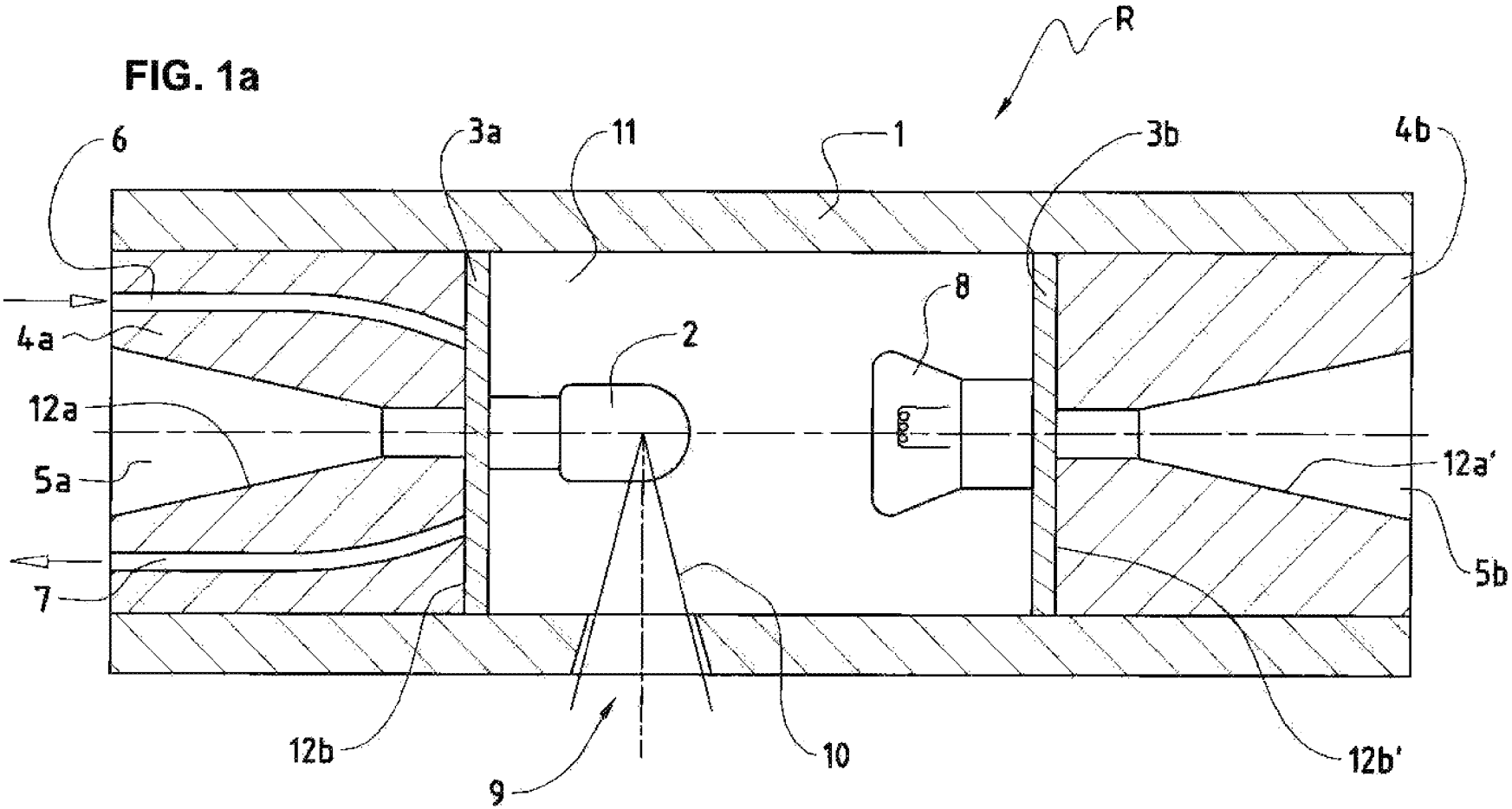
FIG. 1*a* shows a diagrammatic cross-sectional view of a high-voltage X-ray tube from the state of the art having a design with disc-shaped ceramic insulators.

FIG. 1*a* shows diagrammatically a high-voltage X-ray tube R from the state of the art. The high-voltage X-ray tube R has, among other things, an outer jacket or lead covering 1, by means of which an inner space 11 is closed off and sealed off. Normally the high-voltage X-ray tube R is of coaxial design, as is shown by a central axis in FIG. 1*a*. The inner space 11 is essentially under vacuum, which vacuum is generated once during the manufacture of the high-voltage X-ray tube R. In this inner space 11, an anode 2 and a cathode 8 are situated opposite one another. By means of applied high voltage, electrons e- are accelerated from the cathode 8 to the anode 2. X-rays 10 are thereby created at the anode 2, which X-rays are emitted through an exit aperture 9 in the lead covering 1 into the surrounding area.

The anode 2 and the cathode 8 are insulated by disc-shaped insulation elements from the lead covering 1. The anode insulation element 3*a* and the cathode insulation element 3*b* thereby have a particular radius so that sufficient voltage sustaining capability can be ensured.

In such a high-voltage X-ray tube R from the state of the art, the high voltage is supplied using specially designed insulating adapters 4*a* and 4*b*. These adapters 4*a* and 4*b* each have openings 5*a* and 5*b*, in which high-voltage plugs can be plugged in, which supply the tube anode 2 or respectively tube cathode 8 in a suitable way with high voltage via the ceramic disc element.

With a bipolar high-voltage X-ray tube R, a special coolant, for example an insulating cooling oil, must be used for cooling of the anode 2. The cooling oil will be thereby conducted through the adapter 4*a* through specially designed channels 6, 7. One channel 6 serves thereby as inflow channel for the cooling oil, while the channel 7 is used as outflow channel. A circuit is thereby created for the coolant which flows through the channel 6 to the anode, absorbs here the excess heat, and then flows through the channel 7 out again out of the adapter 4*a*. The two reference numerals 12*a* and 12*b*, or respectively 12*a*' and 12*b*', refer to two separated insulation bounding surfaces, which occur owing to the construction of the adapter 4*a*, or respectively 4*b*, and which represent additional risks for high voltage flashover.

Figure 1B:
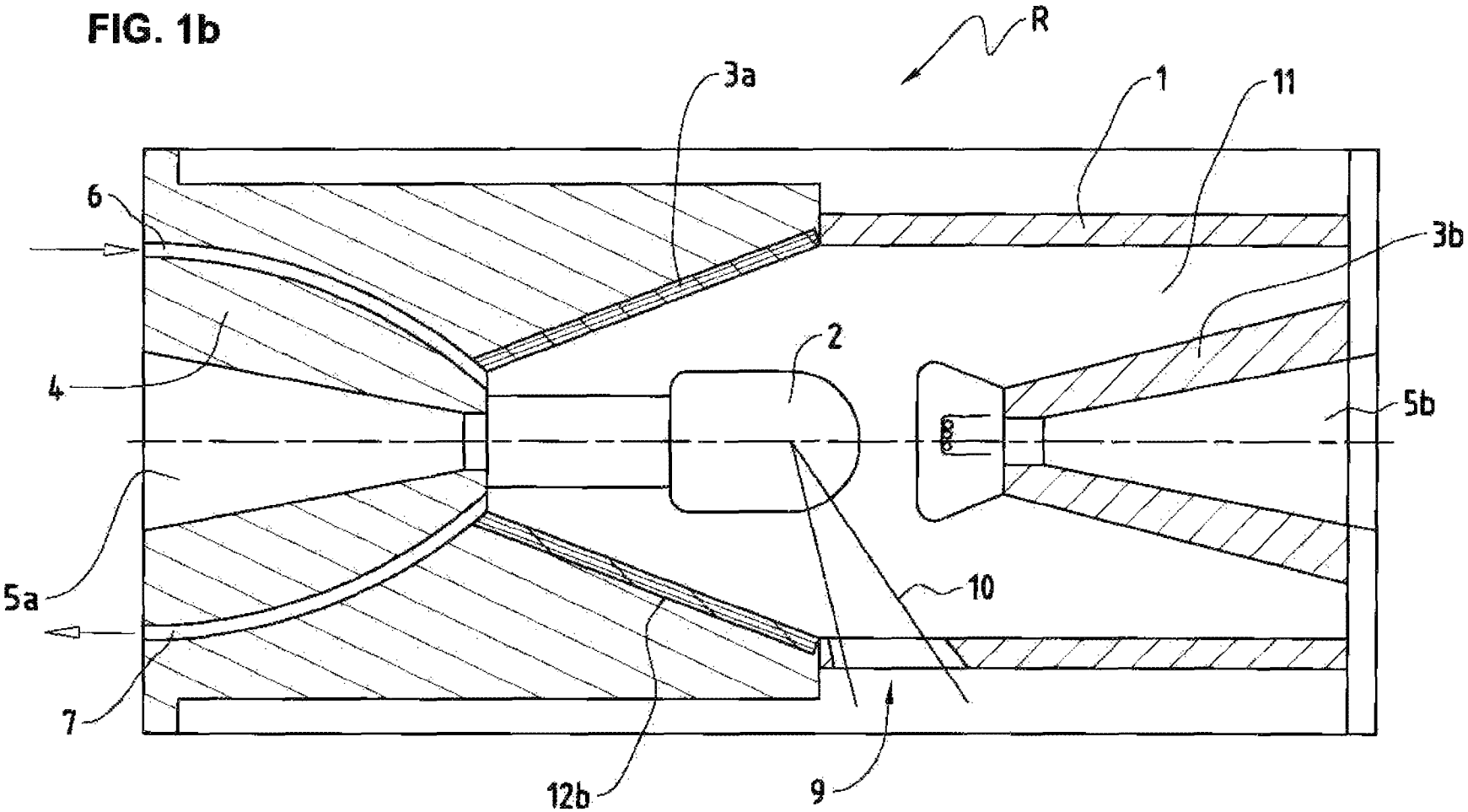
FIG. 1*b* shows a diagrammatic cross-sectional view of a high-voltage X-ray tube from the state of the art having a design with conical ceramic insulators.

Illustrated diagrammatically in FIG. 1*b* is a different high-voltage X-ray tube R from the state of the art. This high-voltage X-ray tube R now comprises conical electrode insulation elements 3*a* and 3*b*. The elements described in FIG. 1*a* are given the same reference numerals also in FIG. 1*b*. Thus the reference numeral 1 refers to the outer jacket or respectively the lead covering of the high-voltage X-ray tube R, the reference numeral 2 to the anode, the reference numerals 6 and 7 to the inflow channel, respectively to the outflow channel, the reference numeral 9 to the exit aperture for the X-rays 10, and the reference numeral 11 to the vacuumized inner space of the high-voltage X-ray tube R.

With the high-voltage X-ray tube R from FIG. 1*b*, the field strength runs to a large extent perpendicular to the surface, thanks to the conical or respectively cylindrical electrode insulators 3*a* and 3*b*. Thus this high-voltage X-ray tube R is also not as susceptible to electrical flashover. The cathode insulation element 3*b* in FIG. 1*b* has an opening 5*b*, which can receive a commercially available high-voltage plug. Since the high-voltage plug can in principle be connected directly to the cathode insulation element 3*b*, a special adapter is not necessary, and the overall length can be kept short. However, on the anode-side another special adapter 4 has to be used, which contains the insulated cooling lines 6 and 7 and the connection 5*a* for the high-voltage plug. An additional bounding surface 12*b*, at risk from high voltage, also results with this high-voltage X-ray tube.

Figure 2:
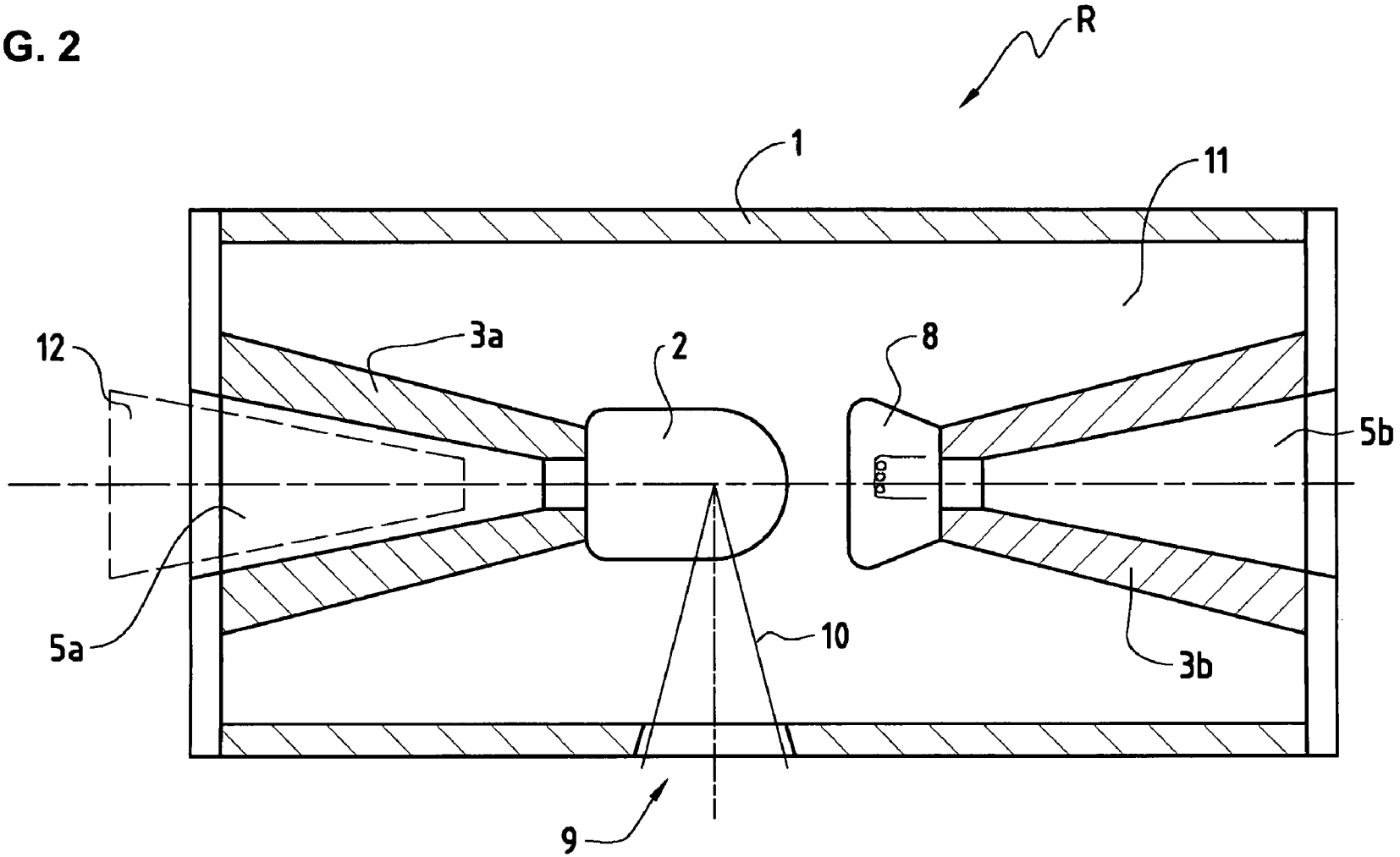
FIG. 2 shows a diagrammatic cross-sectional view of a high-voltage X-ray tube according to the invention.

FIG. 2 shows diagrammatically the structure of an embodiment variant of a high-voltage X-ray tube R according to the invention. Elements known from FIGS. 1*a* and 1*b* are designated using the same reference numerals also in FIG. 2. Thus the reference numeral 1 refers once again to the outer jacket or respectively to the lead covering of the high-voltage X-ray tube R, the reference numeral 2 to the anode, the reference numerals 3*a* and 3*b* to the anode insulation element, respectively to the cathode insulation element, the reference numerals 5*a* and 5*b* to the high-voltage plug connections, the reference numeral 8 to the cathode, the reference numeral 9 to the exit aperture for the X-radiation 10, and the reference numeral 11 to the inner space of the high-voltage X-ray tube R.

In FIG. 2, the anode insulation element 3*a* likewise has a cylindrical shape or respectively a shape tapering toward the anode 2. In addition, the anode insulation element 3*a* comprises such an opening 5*a* for receiving a high-voltage plug 12, making possible a direct connection without adapters or such intermediate elements being needed. According to the invention, a pipe structure is also provided by means of which a coolant can be supplied to the anode 2. The different embodiment variants of the invention will be shown in the subsequent figures.

Figure 3:
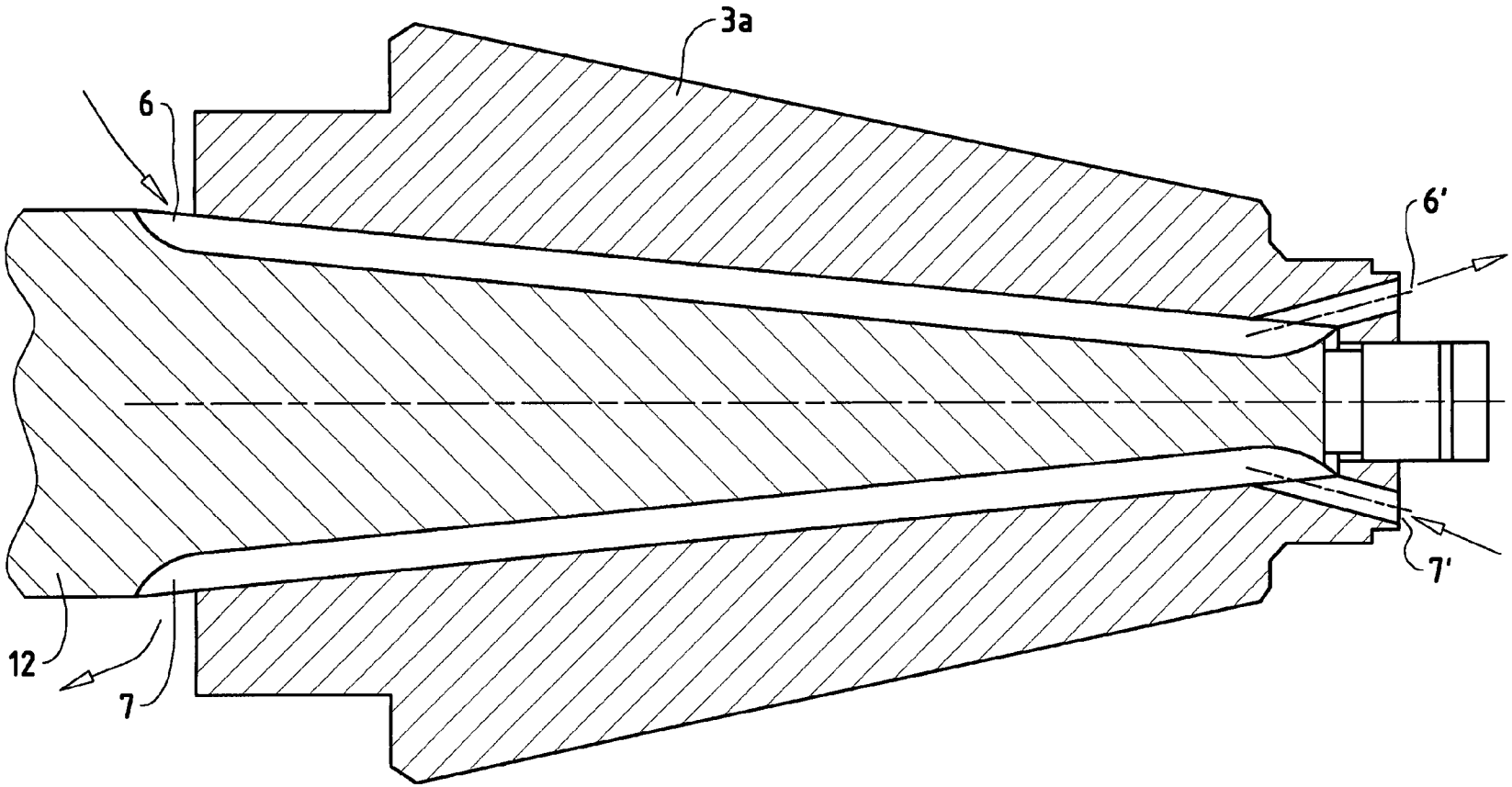
FIG. 3 shows a diagrammatic cross-sectional view of the anode insulation element of the high-voltage X-ray tube with the corresponding high-voltage plug according to a first embodiment variant of the invention.

FIG. 3 illustrates a first embodiment variant of the invention, in which the pipe structure with the inflow channel 6, and the outflow channel 7, is integrated into the surface of the high-voltage plug 12. In this first embodiment variant, the conical high-voltage plug 12 has in its surface open, groove-shaped channels 6 and 7 through which the coolant (in particular the cooling oil or another suitable cooling liquid) can be conducted. Through the press fit of the rubber cone 12 in the ceramic cone 3*a*, the oil channels 6, 7 are sealed off laterally, so that no oil leaks can occur. At its end, the inflow channel 6 has an opening 6', through which the cooling liquid can escape to the anode 2. On the other side, the cooling liquid can reach the outflow channel 7 through the opening 7', after the exchange of heat. In particular, these openings 6' and 7' can be situated partially or completely in the anode insulation element 3*a*. The channels 6 and 7 can be disposed rectilinearly, but also helically. It is also possible moreover to run a plurality of inflow and/or outflow channels 6, 7 parallel, in order to reduce the drop in pressure or respectively increase the flow rate of the cooling liquid.

Figure 4:
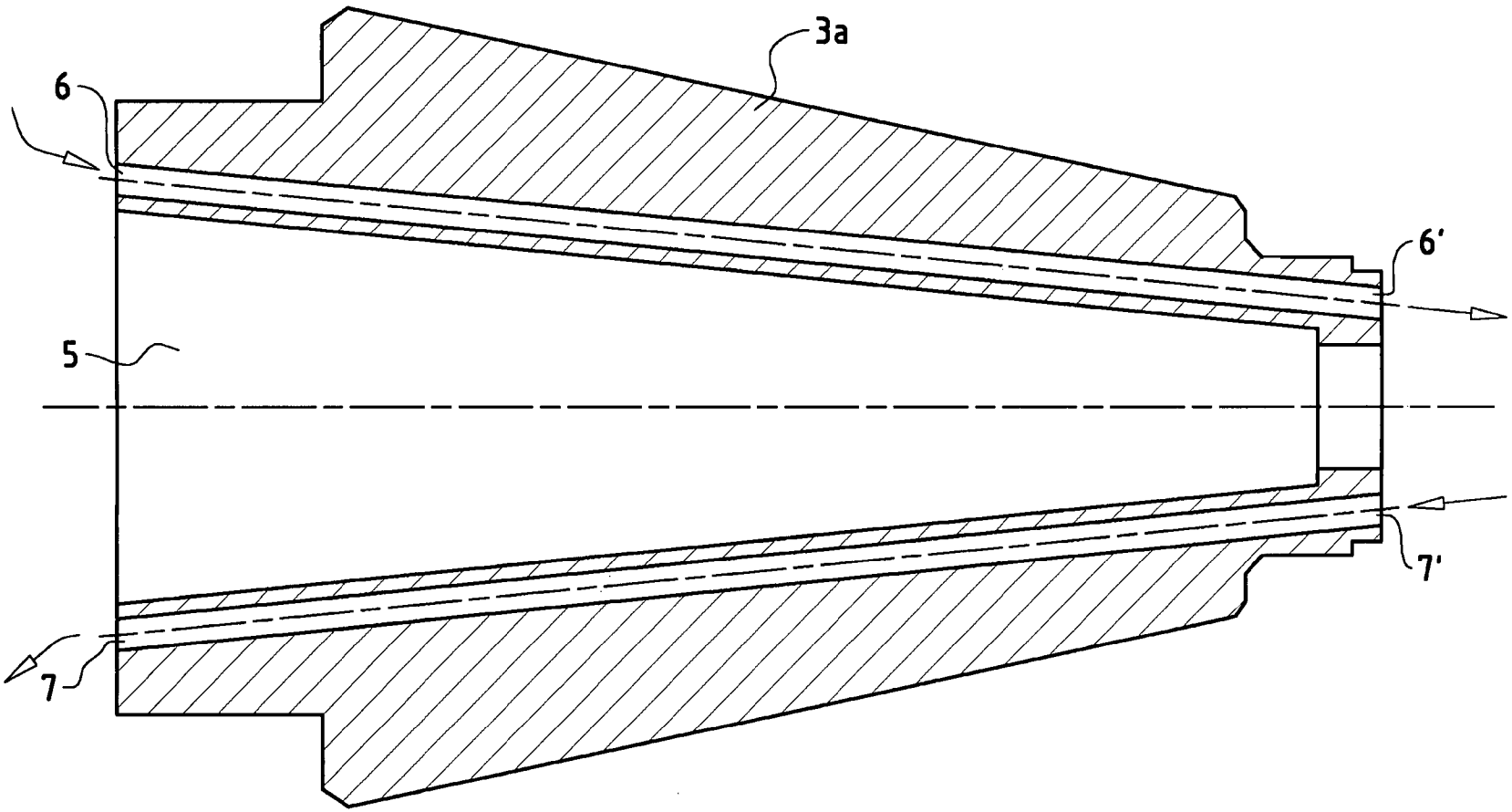
FIG. 4 shows a diagrammatic cross-sectional view of the anode insulation element of the high-voltage X-ray tube with the corresponding high-voltage plug according to a second embodiment variant of the invention.

A second embodiment variant of the invention, in which the pipe structure with the inflow channel 6 and the outflow channel 7 is completely integrated into the interior of the anode insulation element 3*a*, is shown in FIG. 4. In this second embodiment variant, the conical ceramic anode insulation element 3*a* is provided with bores 6, 7, which run in the ceramic wall and serve to guide the coolant flow. These bores 6, 7 are advantageously made in the preform before firing of the ceramic. If need be, the channels 6, 7 can also be integrated into the anode insulation element 3*a* by casting or another suitable production method. The coolant enters the inflow channel 6, and leaves it through the opening 6'. Afterwards the coolant can flow into the outflow channel 7 through the opening 7'. In this embodiment variant, above all the bounding surface between the insulation element 3*a* and the high-voltage plug is not changed. Standard plugs can thereby be used. Also in this embodiment variant, the pipe structure can have rectilinear or also helical channels 6, 7. Moreover it is also possible in this embodiment variant to run a plurality of channels 6, 7 parallel in order to reduce the drop in pressure or respectively increase the oil flow rate.

Figure 5:
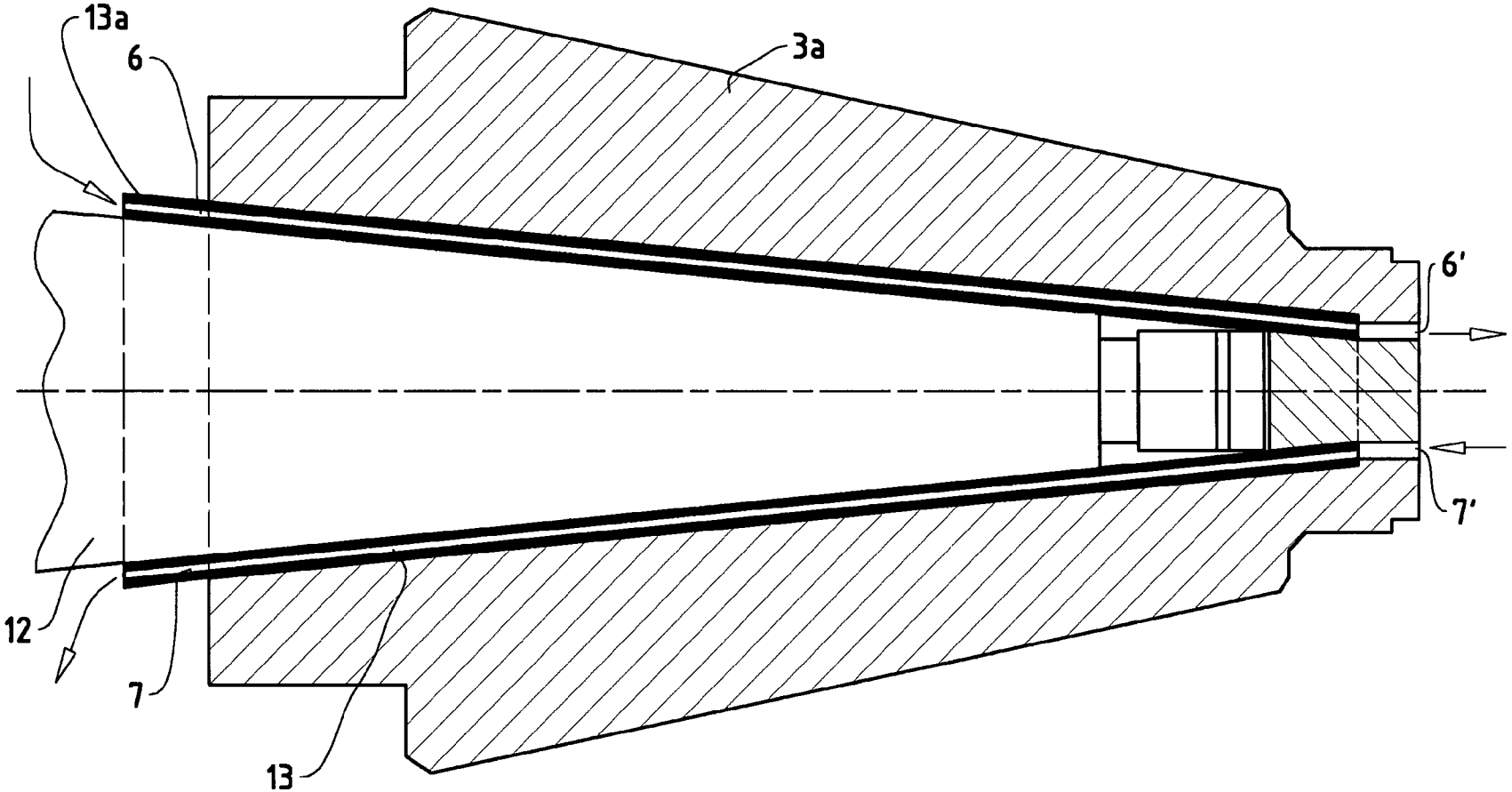
FIG. 5 shows a diagrammatic cross-sectional view of the anode insulation element of the high-voltage X-ray tube with the corresponding high-voltage plug according to a third embodiment variant of the invention.

FIG. 5 shows a third embodiment variant of the invention in which the pipe structure with the inflow channel 6 and the outflow channel 7 is integrated into an intermediate element 13, the intermediate element 13 being disposed between the anode insulation element 3*a* and the high-voltage plug 12. This third embodiment variant thus comprises an intermediate element 13, which is inserted between the anode insulation element 3*a* and the high-voltage plug 12. This intermediate element 13 now contains the inflow and outflow channels 6, 7 for the supply and removal of the coolant to the anode 2. The intermediate part 13 can be sealed off by means of a suitable method in a gap-free way with respect to the ceramic cone of the anode insulation element 3*a*. This can take place e.g. with oil, grease or a thin silicon sleeve. Of course other sealing means and methods are absolutely conceivable as well.

In this embodiment variant, the intermediate element 13 is plugged directly into a standard anode insulation element 3*a*. Consequently this intermediate element 13 must be lengthened outwardly in such a way (the extension 13*a*) that once again a standardized high-voltage plug 12 may be used. Otherwise the anode insulation element 3*a* can be made somewhat broader in order to make space for the intermediate element 13. Standardized high-voltage plugs 12 can thereby continue to be used.

Figure 6A:
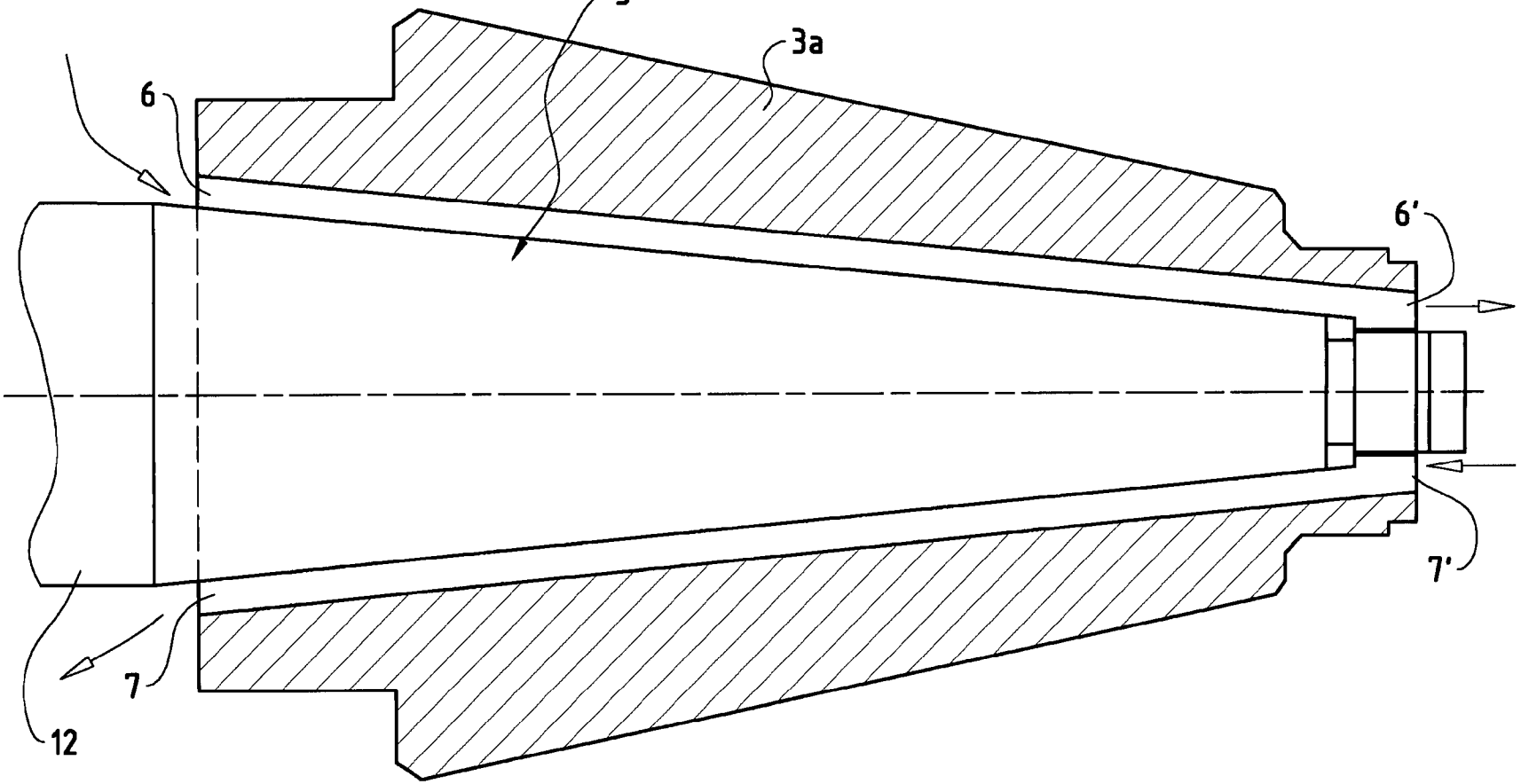
FIG. 6*a* shows a diagrammatic cross-sectional view of the anode insulation element of the high-voltage X-ray tube with the corresponding high-voltage plug according to a fourth embodiment variant of the invention.
Figure 6B:
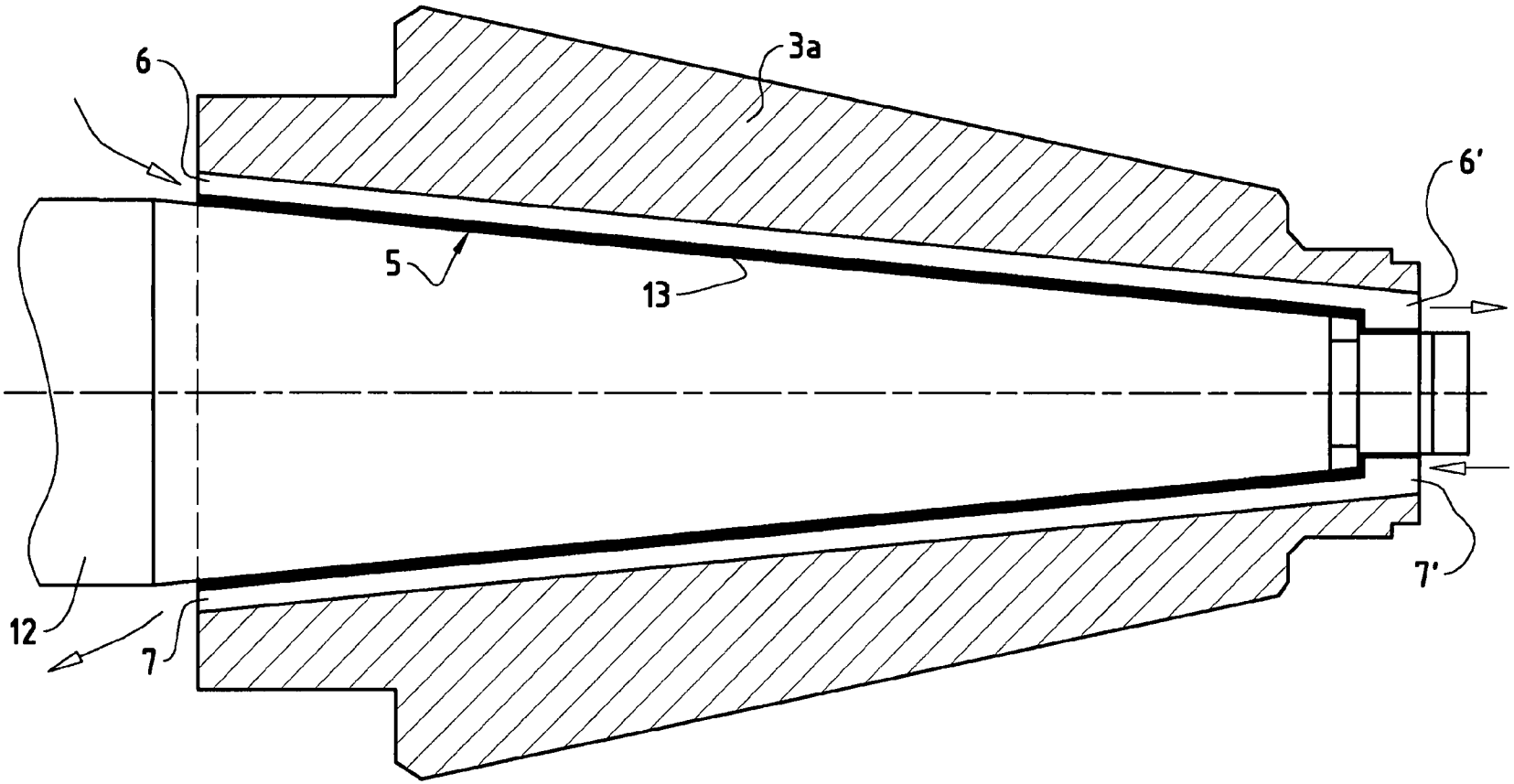
FIG. 6*b* shows a diagrammatic cross-sectional view of the anode insulation element of the high-voltage X-ray tube with the corresponding high-voltage plug according to a fifth embodiment variant of the invention.

FIGS. 6*a* and 6*b* show respectively the fourth and fifth embodiment variants of the present invention. In these embodiment variants, the pipe structure 6, 7 in both cases is integrated as a groove or channel structure in the surface of the anode insulation element 3*a* turned toward the high-voltage plug 12, it being at least partially open toward the outside. Shown in FIG. 6*a* is the embodiment variant in which the channels 6 and 7 are sealed off directly by the surface of the high-voltage plug 12. Alternatively (as shown in FIG. 6*b*), additional, thin-walled sealing means 13 can also be used, which seal off the oil-conducting channels 6, 7 on the one side, and, on the other side, provide the guiding means for the high-voltage plug 12. Also in these two cases, the channels 6, 7 can be run straight or in a helical way. Likewise a plurality of grooves can also be used in parallel.

By installing the cooling channels in the boundary layer between the anode insulation element 3*a* and high-voltage plug 12, or respectively in the anode insulation element 3*a* itself, it is possible, even with conical or cylindrical insulators, to supply the cooling oil to the anode 2, which is under high voltage, with simple components or even completely without separate components. The advantages of this design are not thereby lost, i.e. the high-voltage X-ray tube R remains compact, robust and reliable.

The invention is not limited to the embodiment variants described. It will be immediately clear to one skilled in that art that further developments and modifications within the scope of the protected invention are possible by implication. Elements of the device can be substituted, depending upon need, by other elements that fulfill the same or similar functions. Likewise additional devices and elements can be provided. For example, the anode insulation element 3*a* can also have a cylindrical inner bore in which the high-voltage plug 12 can then be inserted. The connection between the plug 12 and the ceramic element 3*a* is made in this case by means of a flexible intermediate element 13, which fits snugly on the ceramic element 3*a*. In particular, a constant pressing pressure is ensured by the cylindrical shape. The flexible intermediate element 13 can be advantageously designed in such a way that channels 6, 7 are created for the supply and removal of coolant, which run along between the high-voltage plug 12 and the ceramic anode insulation element 3*a* in a straight or helical way. A maintenance-free high-voltage plug 12 can thereby be achieved. These and many other measures and elements fall within the scope of protection of the invention which is defined by the following claims.

The invention claimed is:

1. A high-voltage X-ray tube, comprising a cathode, the cathode being held at negative high voltage during operating conditions, an anode, the anode being held at positive high voltage during operating conditions, the cathode and the anode being disposed opposite each other in a vacuumized inner space, the anode being attached to an anode insulation element, a high voltage plug, the anode insulation element having a cylindrical shape or a shape tapering toward the anode, the anode insulation element including an opening to receive the high-voltage plug, a pipe structure through which a coolant is adapted to be supplied to the anode, and an intermediate element into which the pipe structure is integrated, the pipe structure being at least partially defined by one or more grooves formed in an external surface of the intermediate element, the intermediate element being disposed between the anode insulation element and the high voltage plug, the intermediate element being directly plugged into the anode insulation element.

2. The high-voltage X-ray tube of claim 1, wherein the coolant is insulating oil or another electrically non-conducting liquid.

3. The high-voltage X-ray tube of claim 1, wherein the pipe structure comprises at least one inflow channel and at least one outflow channel.

4. The high-voltage X-ray tube of claim 3, wherein at least one of the at least one inflow channel and the at least one outflow channel are of helical design.

5. The high-voltage X-ray tube of claim 3, wherein at least one of the at least one inflow channel and the at least one outflow channel are of rectilinear design.

6. The high-voltage X-ray tube of claim 3, wherein the pipe structure is produced by boring and/or casting.

7. The high-voltage X-ray tube of claim 3, wherein at least one of the at least one inflow channel and the at least one outflow channel have a round or oval cross section.

8. The high-voltage X-ray tube of claim wherein the intermediate element is in direct contact with both the anode insulation element and the high voltage plug.

* * * * *